US008538763B2

(12) United States Patent
Yu

(10) Patent No.: US 8,538,763 B2
(45) Date of Patent: Sep. 17, 2013

(54) SPEECH ENHANCEMENT WITH NOISE LEVEL ESTIMATION ADJUSTMENT

(75) Inventor: Rongshan Yu, Singapore (SG)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 859 days.

(21) Appl. No.: 12/677,087

(22) PCT Filed: Sep. 10, 2008

(86) PCT No.: PCT/US2008/010589

§ 371 (c)(1), (2), (4) Date: Mar. 8, 2010

(87) PCT Pub. No.: WO2009/035613

PCT Pub. Date: Mar. 19, 2009

(65) Prior Publication Data

US 2010/0198593 A1 Aug. 5, 2010

Related U.S. Application Data

(60) Provisional application No. 60/993,548, filed on Sep. 12, 2007.

(51) Int. Cl.
*G10L 19/00* (2013.01)

(52) U.S. Cl.
USPC ..... 704/500; 704/200; 704/206; 704/225; 704/226

(58) Field of Classification Search
USPC ..... 704/500, 200, 206, 225, 226
See application file for complete search history.

(56) References Cited

U.S. PATENT DOCUMENTS 4,811,404 A 3/1989 Vilmur
6,289,309 B1 9/2001 Devries (Continued)

FOREIGN PATENT DOCUMENTS

WO 00/63887 A1 10/2000
WO 01/13364 A1 2/2001

(Continued)

OTHER PUBLICATIONS

Ephraim, Y., et al., "Speech enhancement using a minimum mean square error log-spectral amplitude estimator", IEEE Trans. Acoust., Speech, Signal Processing, vol. 33, pp. 443-445, Dec. 1985.

(Continued)

*Primary Examiner* — Qi Han

(57) ABSTRACT

Enhancing speech components of an audio signal composed of speech and noise components includes controlling the gain of the audio signal in ones of its subbands, wherein the gain in a subband is reduced as the level of estimated noise components increases with respect to the level of speech components, wherein the level of estimated noise components is determined at least in part by (1) comparing an estimated noise components level with the level of the audio signal in the subband and increasing the estimated noise components level in the subband by a predetermined amount when the input signal level in the subband exceeds the estimated noise components level in the subband by a limit for more than a defined time, or (2) obtaining and monitoring the signal-to-noise ratio in the subband and increasing the estimated noise components level in the subband by a predetermined amount when the signal-to-noise ratio in the subband exceeds a limit for more than a defined time.

12 Claims, 3 Drawing Sheets

(56) References Cited

U.S. PATENT DOCUMENTS

| | | | | |
|---|---|---|---|---|
| 6,415,253 | B1 * | 7/2002 | Johnson | 704/210 |
| 6,477,489 | B1 | 11/2002 | Lockwood et al. | |
| 6,732,073 | B1 | 5/2004 | Kluender et al. | |
| 6,760,435 | B1 | 7/2004 | Etter et al. | |
| 6,993,480 | B1 | 1/2006 | Klayman | |
| 7,117,145 | B1 * | 10/2006 | Venkatesh et al. | 704/200 |
| 7,191,122 | B1 | 3/2007 | Gao et al. | |
| 2004/0078200 | A1 | 4/2004 | Alves | |
| 2005/0027520 | A1 * | 2/2005 | Mattila et al. | 704/228 |
| 2005/0240401 | A1 | 10/2005 | Ebenezer | |
| 2006/0206320 | A1 | 9/2006 | Li | |
| 2007/0094017 | A1 | 4/2007 | Zinser, Jr. et al. | |

FOREIGN PATENT DOCUMENTS

| | | | |
|---|---|---|---|
| WO | 03/015082 | A1 | 2/2003 |
| WO | 2004/013840 | A1 | 2/2004 |

OTHER PUBLICATIONS

Boll, S.F., "Suppression of acoustic noise in speech using spectral subtraction," IEEE Trans. Acoust., Speech, Signal Processing, vol. 27, pp. 113-120, Apr. 1979.

Ephraim, Y., et al., "A brief survey of Speech Enhancement," The Electronic Handbook, CRC Press, Apr. 2005.

Ephrain, Y., et al., "Speech enhancement using a minimum mean square error short time spectral amplitude estimator," IEEE Trans. Acoust., Speech, Signal Processing, vol. 32, pp. 1109-1121, Dec. 1984.

Thomas, I., et al., "Preprocessing of Speech for Added Intelligibility in High Ambient Noise", 34th Audio Engineering Society Convention, Mar. 1968.

Villchur, E., "Signal Processing to Improve Speech Intelligibility for the Hearing Impaired", 99th Audio Engineering Society Convention, Sep. 1995.

Virag, V., "Single channel speech enhancement based on masking properties of the human auditory system," IEEE Tran. Speech and Audio Processing, vol. 7, pp. 126-137, Mar. 1999.

Martin, R., "Spectral subtraction based on minimum statistics," in Proc. EUSIPCO, 1994, pp. 1182-1185.

Wolfe, P. J., "Efficient alternatives to Ephraim and Malah suppression rule for audio signal enhancement," EURASIP Journal on Applied Signal Processing, vol. 2003, Issue 10, pp. 1043-1051, 2003.

B. Widrow, et al., Adaptive Signal Processing. Englewood Cliffs, NJ: Prentice Hall, 1985.

Intl Searching Authority, "Notification of Transmittal of the Intl Search Report and the Written Opinion of the Intl Searching Authority, or the Declaration", mailed Jun. 30, 2008 for Intl Application No. PCT/US2008/003453.

Terhardt, E., "Calculating Virtual Pitch," Hearing Research, pp. 155-182, 1, Oct. 16, 1978.

ISO/IEC JTC1/SC29WG11, Information Technology—Coding of moving pictures and associated audio for digital storage media at up to about 1.5 Mbit/s—Part3: Audio, IS 11172-3, 1992.

Johnston, J., "Transform coding of audio signals using perceptual noise criteria," IEEE J. Select. Areas Commun., vol. 6, pp. 314-323, Feb. 1988.

Gustafsson, S. et al., "A novel psychoacoustically motivated audio enhancement algorithm preserving background noise characteristics," Proceedings of the 1998 IEEE International Conference on Acoustics, Speech, and Signal Processing, 1998. ICASSP '98.

Hu, Yi, et al., "Incorporating a psychoacoustic model in frequency domain speech enhancement," IEEE Signal Processing Letter, pp. 270-273, vol. 11, No. 2, Feb. 2004.

Lin, L., et al., "Speech denoising using perceptual modification of Wiener filtering," Electronics Letter, pp. 1486-1487, vol. 38, Nov. 2002.

Kondoz, A.M., "Digital Speech: Coding for Low Bit Rate Communication Systems," John Wiley & Sons, Ltd., 2nd Edition, 2004, Chichester, England, Chapter 10: Voice Activity Detection, pp. 357-377.

Schaub, A., "Spectral sharpening for speech enhancement noise reduction", Proc. ICASSP 1991, Toronto, Canada, May 1991, pp. 993-996.

Sondhi, M., "New methods of pitch extraction", Audio and Electroacoustics, IEEE Transactions, Jun. 1968, vol. 16, Issue 2, pp. 262-266.

Moore, B. et. al., "A Model for the Prediction of Thresholds, Loudness, and Partial Loudness", J. Audio Eng. Soc., vol. 45, No. 4, Apr. 1997.

Moore, B., et al., "Psychoacoustic consequences of compression in the peripheral auditory system", The Journal of the Acoustical Society of America—Dec. 2002—vol. 112, Issue 6, pp. 2962-2966.

Sallberg, B., et. al., "Analog Circuit Implementation for Speech Enhancement Purposes Signals"; Systems and Computers, 2004. Conference Record of the Thirty-Eighth Asilomar Conference.

Magotra, N., et al., "Real-time digital speech processing strategies for the hearing impaired"; Acoustics, Speech, and Signal Processing, 1997. ICASSP-97., 1997 pp. 1211-1214 vol. 2.

Walker, G., et al., "The effects of multichannel compression/expansion amplification on the intelligibility of nonsense syllables in noise"; The Journal of the Acoustical Society of America—Sep. 1984—vol. 76, Issue 3, pp. 746-757.

Vinton, M., et al., "Automated Speech/Other Discrimination for Loudness Monitoring," AES 118th Convention. 2005.

Scheirer, E., et. al., "Construction and evaluation of a robust multifeature speech/music discriminator", IEEE Transactions on Acoustics, Speech, and Signal Processing (ICASSP'97), 1997, pp. 1331-1334.

Hirsch, H.G., et al., "Noise Estimation Techniques for Robust Speech Recognition", Acoustics, Speech, and Signal Processing, May 9, 1995, Int'l Conf. on Detroit, vol. 1, pp. 153-156.

Martin, Rainer, Noise Power Spectral Density Estimation Based on Optimal Smoothing and Minimum Statistics, IEEE Transactions on Speech and Audio Processing, Jul. 1, 2001, Section II, Vol. 9, p. 505.

Intl Searching Authority, "Notification of Transmittal of the Intl Search Report and the Written Opinion of the Intl Searching Authority, or the Declaration", mailed Jun. 25, 2008 for Intl Application No. PCT/US2008/003436.

Tsoukalas, D., et al., "Speech Enhancement Using Psychoacoustic Criteria", Intl Conf. on Acoustics, Speech, and Signal Processing, Apr. 27-30, 1993, vol. 2, pp. 359-362.

Intl Searching Authority, "Notification of Transmittal of the Intl Search Report and the Written Opinion of the Intl Searching Authority, or the Declaration", mailed Dec. 12, 2008 for Intl Application No. PCT/US2008/010589.

Cohen, et al., "Speech enhancement for non-stationary noise environments", Signal Processing, Elsevier Science Publishers B.V., Amsterdam, NL, vol. 81, No. 11, Nov. 1, 2001, pp. 2403-2418.

* cited by examiner

SPEECH ENHANCEMENT WITH NOISE LEVEL ESTIMATION ADJUSTMENT

TECHNICAL FIELD

The invention relates to audio signal processing. More particularly, it relates to speech enhancement of a noisy audio speech signal. The invention also relates to computer programs for practicing such methods or controlling such apparatus.

INCORPORATION BY REFERENCE

The following publications are hereby incorporated by reference, each in their entirety.

[1] S. F. Boll, "Suppression of acoustic noise in speech using spectral subtraction," *IEEE Trans. Acoust., Speech, Signal Processing*, vol. 27, pp. 113-120, April 1979.

[2] Y. Ephraim, H. Lev-Ari and W. J. J. Roberts, "A brief survey of Speech Enhancement," The Electronic Handbook, CRC Press, April 2005.

[3] Y. Ephraim and D. Malah, "Speech enhancement using a minimum mean square error short time spectral amplitude estimator," *IEEE Trans. Acoust., Speech, Signal Processing*, vol. 32, pp. 1109-1121, December 1984.

[4] Thomas, I. and Niederjohn, R., "Preprocessing of Speech for Added Intelligibility in High Ambient Noise", 34th Audio Engineering Society Convention, March 1968.

[5] Villchur, E., "Signal Processing to Improve Speech Intelligibility for the Hearing Impaired", 99th Audio Engineering Society Convention, September 1995.

[6] N. Virag, "Single channel speech enhancement based on masking properties of the human auditory system," *IEEE Tran. Speech and Audio Processing*, vol. 7, pp. 126-137, March 1999.

[7] R. Martin, "Spectral subtraction based on minimum statistics," in *Proc. EUSIPCO,* 1994, pp. 1182-1185.

[8] P. J. Wolfe and S. J. Godsill, "Efficient alternatives to Ephraim and Malah suppression rule for audio signal enhancement," *EURASIP Journal on Applied Signal Processing*, vol. 2003, Issue 10, Pages 1043-1051, 2003.

[9] B. Widrow and S. D. Stearns, *Adaptive Signal Processing*. Englewood Cliffs, N.J.: Prentice Hall, 1985.

[10] Y. Ephraim and D. Malah, "Speech enhancement using a minimum mean square error Log-spectral amplitude estimator," *IEEE Trans. Acoust., Speech, Signal Processing*, vol. 33, pp. 443-445, December 1985.

[11] E. Terhardt, "Calculating Virtual Pitch," *Hearing Research*, pp. 155-182, 1, 1979.

[12] ISO/IEC JTC1/SC29/WG11, *Information technology—Coding of moving pictures and associated audio for digital storage media at up to about* 1.5 *Mbit/s—Part*3: *Audio*, IS 11172-3, 1992

[13] J. Johnston, "Transform coding of audio signals using perceptual noise criteria," *IEEE J. Select. Areas Commun.*, vol. 6, pp. 314-323, February 1988.

[14] S. Gustafsson, P. Jax, P Vary, "A novel psychoacoustically motivated audio enhancement algorithm preserving background noise characteristics," *Proceedings of the* 1998 *IEEE International Conference on Acoustics, Speech, and Signal Processing,* 1998. ICASSP '98.

[15] Yi Hu, and P. C. Loizou, "Incorporating a psychoacoustic model in frequency domain speech enhancement," *IEEE Signal Processing Letter*, pp. 270-273, vol. 11, no. 2, February 2004.

[16] L. Lin, W. H. Holmes, and E. Ambikairajah, "Speech denoising using perceptual modification of Wiener filtering," *Electronics Letter*, pp 1486-1487, vol. 38, November 2002.

[17] A. M. Kondoz, "Digital Speech: Coding for Low Bit Rate Communication Systems," John Wiley & Sons, Ltd., $2^{nd}$ Edition, 2004, Chichester, England, Chapter 10: Voice Activity Detection, pp. 357-377.

DISCLOSURE OF THE INVENTION

According to a first aspect of the invention, speech components of an audio signal composed of speech and noise components are enhanced. An audio signal is changed from the time domain to a plurality of subbands in the frequency domain. The subbands of the audio signal are subsequently processed. The processing includes controlling the gain of the audio signal in ones of said subbands, wherein the gain in a subband is reduced as the level of estimated noise components increases with respect to the level of speech components, wherein the level of estimated noise components is determined at least in part by comparing an estimated noise components level with the level of the audio signal in the subband and increasing the estimated noise components level in the subband by a predetermined amount when the input signal level in the subband exceeds the estimated noise components level in the subband by a limit for more than a defined time. The processed subband audio signal is changed from the frequency domain to the time domain to provide an audio signal in which speech components are enhanced. The estimated noise components may be determined by a voice-activity-detector-based noise-level-estimator device or process. Alternatively, the estimated noise components may be determined by a statistically-based noise-level-estimator device or process.

According to another aspect of the invention, speech components of an audio signal composed of speech and noise components are enhanced. An audio signal is changed from the time domain to a plurality of subbands in the frequency domain. The subbands of the audio signal are subsequently processed. The processing includes controlling the gain of the audio signal in ones of said subbands, wherein the gain in a subband is reduced as the level of estimated noise components increases with respect to the level of speech components, wherein the level of estimated noise components is determined at least in part by obtaining and monitoring the signal-to-noise ratio in the subband and increasing the estimated noise components level in the subband by a predetermined amount when the signal-to-noise ratio in the subband exceeds a limit for more than a defined time. The processed subband audio signal is changed from the frequency domain to the time domain to provide an audio signal in which speech components are enhanced. The estimated noise components may be determined by a voice-activity-detector-based noise-level-estimator device or process. Alternatively, the estimated noise components may be determined by a statistically-based noise-level-estimator device or process.

BEST MODE FOR CARRYING OUT THE INVENTION

Figure 1:
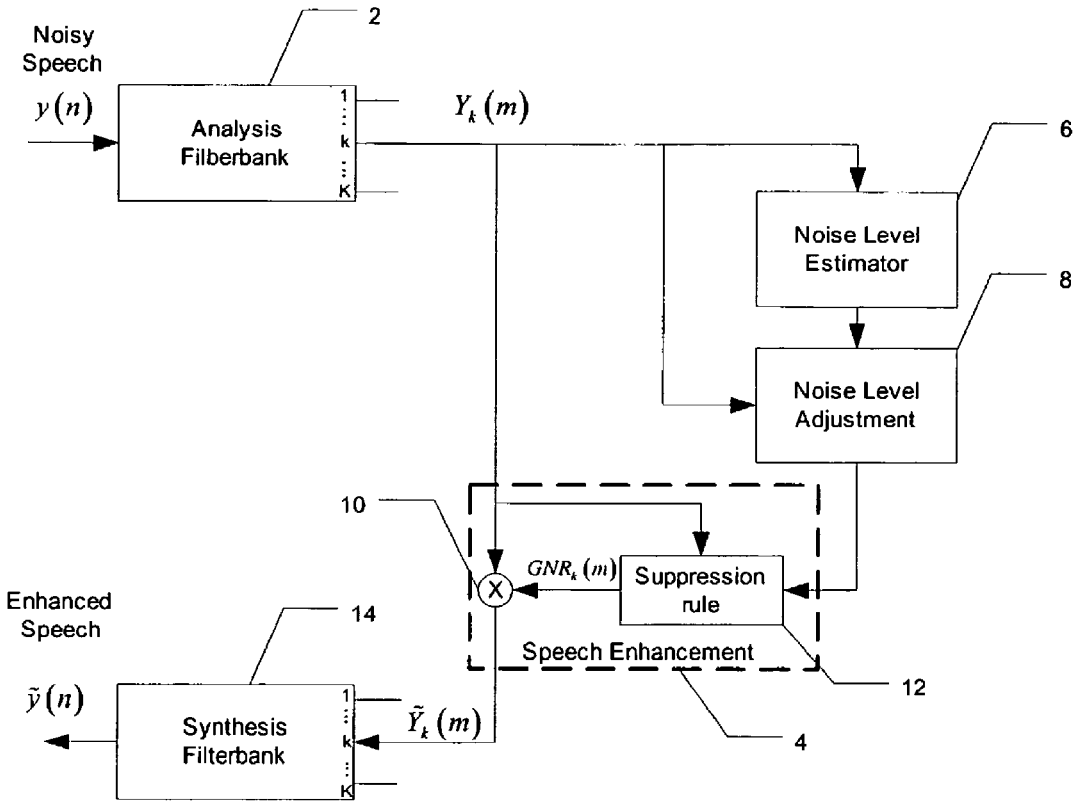
FIG. 1 is a functional block diagram showing an exemplary embodiment of the invention.

FIG. 1 is a functional block diagram showing an exemplary embodiment of aspects of the present invention. The input is generated by digitizing an analog speech signal that contains both clean speech as well as noise. This unaltered audio signal y(n) ("Noisy Speech"), where n=0, 1, . . . is the time index, is then sent to an analysis filterbank device or function ("Analysis Filterbank") 2, producing K multiple subband signals, $Y_k(m)$, k=1, . . . , K, m=0, 1, . . . , ∞, where k is the subband number, and m is the time index of each subband signal. Analysis Filterbank 2 changes the audio signal from the time domain to a plurality of subbands in the frequency domain.

The subband signals are applied to a noise-reducing device or function ("Speech Enhancement") 4, a noise-level estimator or estimation function ("Noise Level Estimator") 6, and a noise-level estimator adjuster or adjustment function ("Noise Level Adjustment") ("NLA") 8.

In response to the input subband signals and in response to an adjusted estimated noise level output of Noise Level Adjustment 8, Speech Enhancement 4 controls a gain scale factor $GNR_k(m)$ that scales the amplitude of the subband signals. Such an application of a gain scale factor to a subband signal is shown symbolically by a multiplier symbol 10. For clarity in presentation, the figures show the details of generating and applying a gain scale factor to only one of multiple subband signals (k).

The value of gain scale factor $GNR_k(m)$ is controlled by Speech Enhancement 4 so that subbands that are dominated by noise components are strongly suppressed while those dominated by speech are preserved. Speech Enhancement 4 may be considered to have a "Suppression Rule" device or function 12 that generates a gain scale factor $GNR_k(m)$ in response to the subband signals $Y_k(m)$ and the adjusted estimated noise level output from Noise Level Adjustment 8.

Speech Enhancement 4 may include a voice-activity detector or detection function (VAD) (not shown) that, in response to the input subband signals, determines whether speech is present in noisy speech signal y(n), providing, for example, a VAD=1 output when speech is present and a VAD=0 output when speech is not present. A VAD is required if Speech Enhancement 4 is a VAD-based device or function. Otherwise, a VAD may not be required.

Enhanced subband speech signals $\tilde{Y}_k(m)$ are provided by applying gain scale factor $GNR_k(m)$ to the unenhanced input subband signals $Y_k(m)$. This may be represented as:

$$\tilde{Y}_k(m)=GNR_k(m)\cdot Y_k(m) \quad (1)$$

The dot symbol ("·") indicates multiplication.

The processed subband signals $\tilde{Y}_k(m)$ may then be converted to the time domain by using a synthesis filterbank device or process ("Synthesis Filterbank") 14 that produces the enhanced speech signal $\tilde{y}(n)$. The synthesis filterbank changes the processed audio signal from the frequency domain to the time domain.

Figure 5:
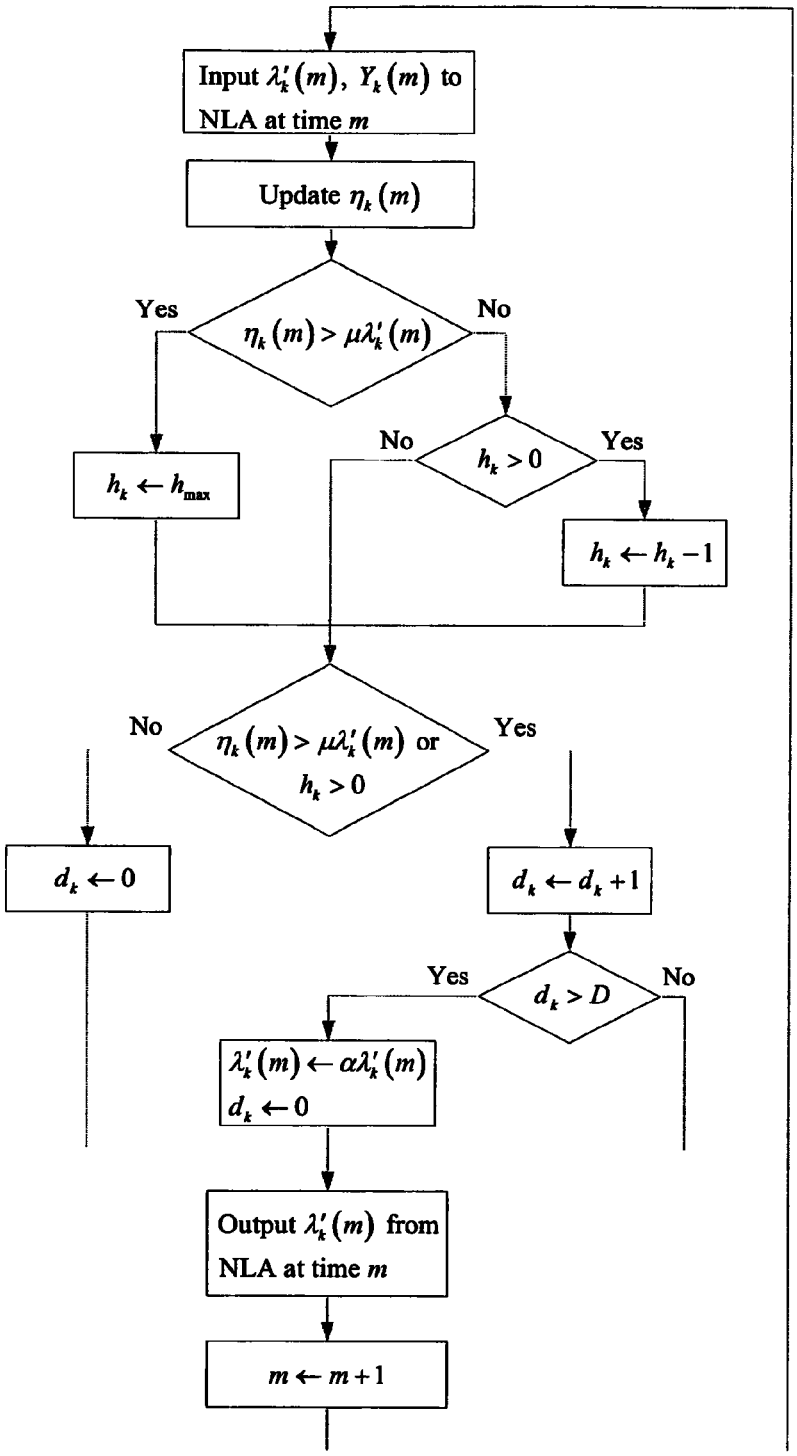
FIG. 5 is a flowchart relating to the exemplary embodiment of FIG. 1.

It will be appreciated that various devices, functions and processes shown and described in various examples herein may be shown combined or separated in ways other than as shown in FIGS. 1 and 5. For example, although Speech Enhancement 4, Noise Level Estimator 6, and Noise Level Adjustment 8 are shown as separate devices or functions, they may, in practice be combined in various ways. Also, for example, when implemented by computer software instruction sequences, functions may be implemented by multithreaded software instruction sequences running in suitable digital signal processing hardware, in which case the various devices and functions in the examples shown in the figures may correspond to portions of the software instructions.

Subband audio devices and processes may use either analog or digital techniques, or a hybrid of the two techniques. A subband filterbank can be implemented by a bank of digital bandpass filters or by a bank of analog bandpass filters. For digital bandpass filters, the input signal is sampled prior to filtering. The samples are passed through a digital filter bank and then downsampled to obtain subband signals. Each subband signal comprises samples which represent a portion of the input signal spectrum. For analog bandpass filters, the input signal is split into several analog signals each with a bandwidth corresponding to a filterbank bandpass filter bandwidth. The subband analog signals can be kept in analog form or converted into in digital form by sampling and quantizing.

Subband audio signals may also be derived using a transform coder that implements any one of several time-domain to frequency-domain transforms that functions as a bank of digital bandpass filters. The sampled input signal is segmented into "signal sample blocks" prior to filtering. One or more adjacent transform coefficients or bins can be grouped together to define "subbands" having effective bandwidths that are sums of individual transform coefficient bandwidths.

Although the invention may be implemented using analog or digital techniques or even a hybrid arrangement of such techniques, the invention is more conveniently implemented using digital techniques and the preferred embodiments disclosed herein are digital implementations. Thus, Analysis Filterbank 2 and Synthesis Filterbank 14 may be implemented by any suitable filterbank and inverse filterbank or transform and inverse transform, respectively.

Although the gain scale factor $GNR_k(m)$ is shown controlling subband amplitudes multiplicatively, it will be apparent to those of ordinary skill in the art that equivalent additive/subtractive arrangements may be employed.

Speech Enhancement 4

Various spectral enhancement devices and functions may be useful in implementing Speech Enhancement 4 in practical embodiments of the present invention. Among such spectral enhancement devices and functions are those that employ VAD-based noise-level estimators and those that employ statistically-based noise-level estimators. Such useful spectral enhancement devices and functions may include those described in references 1, 2, 3, 6 and 7, listed above and in the following two United States Provisional Patent Applications:

(1) "Noise Variance Estimator for Speech Enhancement," of Rongshan Yu, Ser. No. 60/918,964, filed Mar. 19, 2007; and (2) "Speech Enhancement Employing a Perceptual Model," of Rongshan Yu, Ser. No. 60/918,986, filed Mar. 19, 2007.

Other spectral enhancement devices and functions may also be useful. The choice of any particular spectral enhancement device or function is not critical to the present invention.

The speech enhancement gain factor $GNR_k(m)$ may be referred to as a "suppression gain" because its purpose is to suppress noise. One way of controlling suppression gain is known as "spectral subtraction" (references [1], [2] and [7]), in which the suppression gain $GNR_k(m)$ applied to the subband signal $Y_k(m)$ may be expressed as:

$$GNR_k(m) = \sqrt{1 - a\frac{\lambda_k(m)}{|Y_k(m)|^2}}, \quad (2)$$

where $|Y_k(m)|$ is the amplitude of subband signal $Y_k(m)$, $\lambda_k(m)$ is the noise energy in subband k, and a>1 is an "over subtraction" factor chosen to assure that a sufficient suppression gain is applied. "Over subtraction" is explained further in reference [7] at page 2 and in reference 6 at page 127.

In order to determine appropriate amounts of suppression gains, it is important to have an accurate estimation of the noise energy for subbands in the incoming signal. However, it is not a trivial task to do so when the noise signal is mixed together with the speech signal in the incoming signal. One way to solve this problem is to use a voice-activity-detection-based noise level estimator that uses a standalone voice activity detector (VAD) to determine whether a speech signal is present in the incoming signal or not. Many voice activity detectors and detector functions are known. Suitable such device or function is described in Chapter 10 of reference [17] and in the bibliography thereof. The use of any particular voice activity detector is not critical to the invention. The noise energy is updated during the period when speech is not present (VAD=0). See, for example, reference [3]. In such a noise estimator, the noise energy estimation $\lambda_k(m)$ for time m may be given by:

$$\lambda_k(m) = \begin{cases} \beta\lambda_k(m-1) + (1-\beta)|Y_k(m)|^2 & VAD = 0; \\ \lambda_k(m-1) & VAD = 1. \end{cases} \quad (3)$$

The initial value of the noise energy estimation $\lambda_k(-1)$ can be set to zero, or set to the noise energy measured during the initialization stage of the process. The parameter β is a smoothing factor having a value $0 \ll \beta < 1$. When speech is not present (VAD=0), the estimation of the noise energy may be obtained by performing a first order time smoother operation (sometimes called a "leaky integrator") on a power of the input signal $Y_k(m)$ (squared in this example). The smoothing factor β may be a positive value that is slightly less than one. Usually, for a stationary input signal a β value closer to one will lead to a more accurate estimation. On the other hand, the value β should not be too close to one to avoid losing the ability to track changes in the noise energy when the input becomes not stationary. In practical embodiments of the present invention, a value of β=0.98 has been found to provide satisfactory results. However, this value is not critical. It is also possible to estimate the noise energy by using a more complex time smoother that may be non-linear or linear (such as a multipole lowpass filter.)

Figure 2:
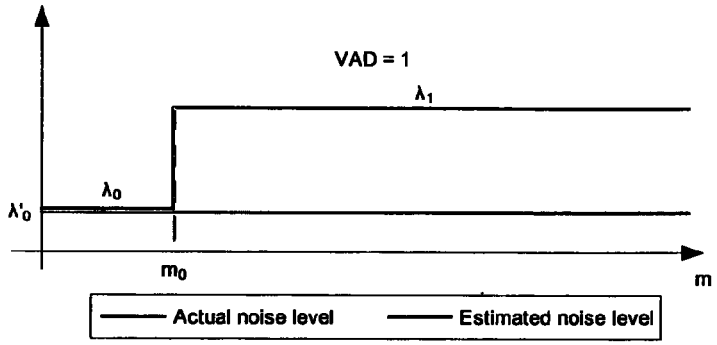
FIG. 2 is an idealized hypothetical plot of actual noise level for estimated noise level for a first example.

There is a tendency for VAD-based noise level estimators to underestimate the noise level. FIG. 2 is an idealized illustration of the noise level underestimation problem for VAD-based noise level estimator. For simplicity in presentation, noise is shown at constant levels in this figure and also in related FIGS. 3 and 4. In FIG. 2, the actual noise level increases from $\lambda_0$ to $\lambda_1$ at time $m_0$. However, because speech is present (VAD=1) throughout the entire time period shown in FIG. 2, starting at m=0, a VAD-based noise estimater does not update the noise level estimation when the actual noise level increases at time $m_0$. Therefore, the noise level is underestimated for $m>m_0$. Such a noise level underestimation, if unaddressed, leads to insufficient amount of suppression of the noise components in the incoming noise signal. As a result, strong residual noise is present in the enhanced speech signal, which may be annoying to a listener.

It is possible to improve the noise level underestimation problem to some extent by using a different noise level estimation process, e.g., the minimum statistics process of reference [7]. In principle, the minimum statistics process keeps a record of historical samples for each subband, and estimates the noise level based on the minimum signal-level samples from the record. The rationale behind this approach is that the speech signal in general is an on/off process and naturally has pauses. In addition, the signal level is generally much higher when the speech signal is present. Therefore, the minimum signal-level samples from the record are likely to be from a speech pause section if the record is sufficiently long in time, and the noise level can be reliably estimated from such samples. Because the minimum statistics method does not rely on explicit VAD detection, it is less subject to the noise level underestimation problem described above. If one goes back to the example shown in FIG. 2, and assumes that the minimum statistic process keeps a record of W samples in its record, it can be seen from FIG. 3, which shows a solution of the noise level underestimation problem with the minimum statistics process, that after $m>m_0+W$, all the samples from time $m<m_0$ will have been shifted out from the record. Therefore, the noise estimation will be totally based on samples from $m \geqq m_0$, from which a more accurate noise level estimation may be obtained. Thus, the use of the minimum statistics process provides some improvement to the problem of noise level underestimation.

In accordance with aspects of the present invention, an appropriate adjustment to the estimated noise level is made to overcome the problem of noise level understimation. Such an adjustment, as may be provided by Noise Level Adjustment device or process 8 in the example of FIG. 1, may be employed either with speech enhancer devices and processes employing either VAD-based or minimum-statistic type noise level estimators or estimator functions.

Referring again to FIG. 1, Noise Level Adjustment 8 monitors the time in which the energy level in each of a plurality of subbands is larger than the estimated noise energy level in each such subband. Noise Level Adjustment 8 then decides that the noise level is underestimated if the time period is longer than a pre-determined maximum value, and increases the noise energy level estimation by a small pre-determined adjustment step size, such as 3 dB. Noise Level Adjustment 8 iteratively increases the estimated noise level until the measured time period no longer exceeds the maximum time period, resulting in a noise level estimation that in most cases is larger than the actual noise level by an amount no larger than the adjustment step size.

Noise Level Adjustment 8 measures the energy of the input signal $\eta_k(m)$ as follows:

$$\eta_k(m) = \kappa\eta_k(m-1) + (1-\kappa)|Y_k(m)|^2, \quad (4)$$

in which κ is a smoothing factor having a value $0 \ll \kappa < 1$. The initial value of the input signal $\eta_k(-1)$ may be set to zero. The parameter κ plays the same role as the parameter β as in Eqn. (3). However, κ may be set to a value that is slightly smaller than β because the energy of the input signal usually changes rapidly when speech is present. It has been found that κ=0.9 gives satisfied results, although the value of κ is not critical to the invention.

The parameter $d_k$ denotes the time during which the incoming signal has a level exceeding the estimated noise level for subband k. At each time m, it is updated as follows in Eqn. 5.

The time period of each m, as in any digital system, is decided by the sampling rate of the subband. So it may vary depending on the sampling rate of the input signal, and the filterbank used. In a practical implementation, the time period for each m is 1(s)/8000*32=4 ms (an 8000 kHz speech signal and a filterbank with a downsampling factor of 32).

$$d_k = \begin{cases} d_k + 1 & \eta_k(m) > \mu\lambda'_k(m) \text{ or } h_k > 0; \\ 0 & \text{else.} \end{cases} \quad (5)$$

where $\mu$ is a pre-determined constant and $d_k$ is set to 0 at the initialization stage of the process. Here $h_k$ is a hand-off counter introduced to improve the robustness of the process, which is calculated at every time index m as:

$$h_k = \begin{cases} h_{max} & \eta_k(m) > \mu\lambda'_k(m); \\ h_k - 1 & \eta_k(m) \le \mu\lambda'_k(m) \text{ and } h_k > 0, \end{cases} \quad (6)$$

where $h_{max}$ is a pre-determined integer and $h_k$ is also set to zero at the process initialization stage. The parameter $\mu$ is a constant larger than one to increase the estimated noise level when compared with the level of the incoming signal to avoid any possible false alarm (that is, the level of the incoming signal exceeding the estimated noise level by a small amount temporarily due to signal fluctuation). In In a practical embodiment $\mu$=2 was found to be a useful value. The value of the parameter $\mu$ is not critical to the invention. Similarly, the hand-off counter is introduced since we also want to avoid reset of counter $d_k$ when the level of the incoming signal falls below the estimated noise temporarily due to signal fluctuation. In a practical embodiment, a maximum hand-off period of $h_{max}$=5 or 20 ms was found to be a useful value. The value of the parameter $h_{max}$ is not critical to the invention.

If Noise Level Adjustment 8 detects that $d_k$ is larger than a pre-selected maximum time duration D, usually some value larger than the maximum possible duration of a phoneme in normal speech, it will then decide that the noise level of subband k is underestimated. In a practical embodiment of the invention, a value of D=150 or 600 ms was found to be a useful value. The value of the parameter D is not critical to the invention. In that case, Noise Level Adjustment 8 updates the estimated noise level for subband k as:

$$\lambda'_k(m) \leftarrow a \cdot \lambda'_k(m), \quad (7)$$

where a>1 is a pre-determined adjustment step size, and resets the counter $d_k$ to zero. Otherwise, it keeps the value of $\lambda'_k(m)$ unchanged. The value of $\alpha$ decides the trade-off between the accuracy of the noise level estimation after the adjustment, and the speed of adjustment when noise level underestimation is detected. In a practical embodiment of the invention, a value of $\alpha$=2 or 3 dB was found to be a useful value. The value of the parameter $\alpha$ is not critical to the invention A flowchart showing an example of the process suitable for use by Noise Level Adjustment 8 is shown in FIG. 5. The flowchart of FIG. 5 shows the process underlying the exemplary embodiment of FIG. 1. The final step indicates that the time index m is then advanced by one ("m←m+1") and the process of FIG. 5 is repeated. The flowchart applies also to the alternative implementation of the invention if the condition $\eta_k(m)>\mu\lambda'_k(m)$ is replaced by $\xi_k>1+\mu$, When a noise level underestimation occurs, the Noise Level Adjustment 8 keeps increasing the estimated noise level until $d_k$ has a value smaller than D. In that case, the estimated noise level $\lambda'_k(m)$ will have a value:

$$\lambda_k \le \lambda'_k(m) < a \cdot \lambda_k, \quad (8)$$

where $\lambda_k$ is the actual noise level in the incoming signal. The second inequality in the above comes from the fact that the Noise Level Adjustment 8 stops increasing the estimated noise level as soon as $\lambda'_k(m)$ has a value larger than $\lambda_k$.

As an alternative implementation, advantage is taken of the fact that many speech enhancement processes actually estimate the signal-to-noise ratio (SNR) $\xi_k$ for each subband, which also gives a good indication of noise level underestimation if it has a large value persistently over a long time period. Therefore, the condition $\eta_k(m)>\mu\lambda'_k(m)$ in the above process can be replaced by $\xi_k>1+\mu$ and the rest of the process remains unchanged.

Figure 3:
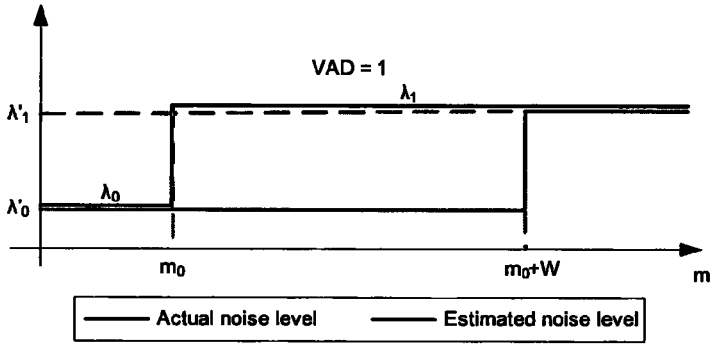
FIG. 3 is an idealized hypothetical plot of actual noise level for estimated noise level for a second example.
Figure 4:
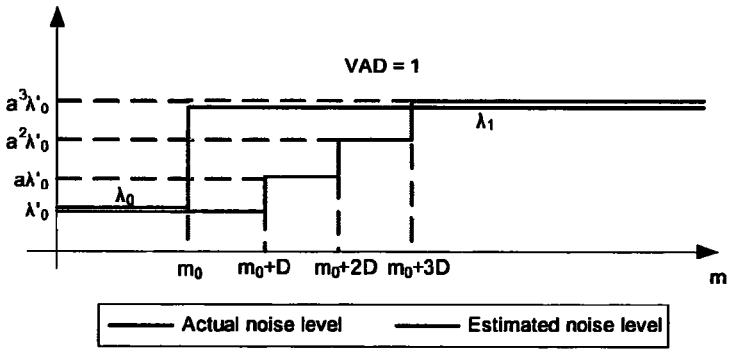
FIG. 4 is an idealized hypothetical plot of actual noise level for estimated noise level for a third example.

Finally, one may use the same example as in FIGS. 2 and 3 to illustrate how the present invention addresses the problem of noise level underestimation. As shown in FIG. 4, Noise Level Adjustment 8 detects that the incoming signal has a level persistently higher than the estimated noise level after time $m_0$ because the actual noise level increases from $\lambda_0$ to $\lambda_1$ at time $m_0$. As a result, Noise Level Adjustment 8 increases the estimated noise level at time $m_0$+kD, where k=1, 2, . . . , until the estimated noise level estimation is close enough to the actual noise level $\lambda_1$. In this particular example, this happens after $m>m_0+3D$ when the estimated noise level has a value $a^3\lambda'_0$ that is slightly larger than $\lambda_1$. By comparison to FIGS. 2 and 3, it will be seen that the present invention provides a more accurate noise estimation, thus providing an improved enhanced speech output.

Implementation

The invention may be implemented in hardware or software, or a combination of both (e.g., programmable logic arrays). Unless otherwise specified, the processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described herein may be order independent, and thus can be performed in an order different from that described.

The invention claimed is:

1. A method for enhancing speech components of an audio signal composed of speech and noise components, comprising:

using a processor and a memory to perform steps comprising:

changing the audio signal from a time domain representation to a plurality of subbands in a frequency domain representation producing K multiple subband signals, $Y_k(m)$, k=1, . . . , K, m=0, 1, . . . , ∞, where k is a subband number, and m is a time index of each subband signal, processing the subbands of the audio signal, wherein a subband has a gain, said processing including controlling the gain of the audio signal in ones of said subbands, wherein the gain in a subband is reduced as a level of estimated noise components increases with respect to the level of speech components, the change of the gain in a subband being performed according to a set of parameters continuously updated for each time index m, said parameters being dependent only on their respective prior value at time index (m−1), characteristics of the subband at time index m, and a set of predetermined constants, wherein the level of estimated noise components is determined at least in part by comparing an estimated noise components level with the level of the audio signal in the subband and increasing the estimated noise components level in the subband by a predetermined amount when the audio signal level in the subband exceeds the estimated noise components level in the subband by a limit for more than a defined time, wherein said defined time is updated according to a counter, said counter being robust with respect to false alarms and resets due to temporary signal fluctuations by introducing a hand-off counter, and changing the processed audio signal from the frequency domain to the time domain to provide an audio signal in which speech components are enhanced.

2. The method of claim 1 wherein the estimated noise components are determined by a voice-activity-detector-based noise-level-estimator device or process.

3. The method of claim 1 wherein the estimated noise components are determined by a statistically-based noise-level-estimator device or process.

4. A method for enhancing speech components of an audio signal composed of speech and noise components, comprising:

using a processor and a memory to perform steps comprising:

changing the audio signal from a time domain representation to a plurality of subbands in a frequency domain representation, producing K multiple subband signals, $Y_k(m)$, k=1, . . . , K, m=0, 1, . . . , ∞, where k is the subband number, and m is a time index of each subband signal, processing subbands of the audio signal, wherein a subband has a gain, said processing including controlling the gain of the audio signal in ones of said subbands, wherein the gain in a subband is reduced as a level of estimated noise components increases with respect to the level of speech components, wherein the level of estimated noise components is determined at least in part by obtaining and monitoring the signal-to-noise ratio in the subband and increasing the estimated noise components level in the subband by a predetermined amount when the signal-to-noise ratio in the subband exceeds a limit for more than a defined time, the change of the gain in a subband being performed according to a set of parameters continuously updated for each time index m, said parameters being dependent only on their respective prior value at time index (m−1), characteristics of the subband at time index m, and a set of predetermined constants, and said defined time being updated according to a counter, said counter being robust with respect to false alarms and resets due to temporary signal fluctuations by introducing a hand-off counter, and changing the processed audio signal from the frequency domain to the time domain to provide an audio signal in which speech components are enhanced.

5. The method of claim 4 wherein the estimated noise components are determined by a voice-activity-detector-based noise-level-estimator device or process.

6. The method of claim 4 wherein the estimated noise components are determined by a statistically-based noise-level-estimator device or process.

7. A non-transitory computer-readable storage medium encoded with a computer program for causing a computer to perform steps comprising:

changing the audio signal from a time domain representation to a plurality of subbands in a frequency domain representation producing K multiple subband signals, $Y_k(m)$, k=1, . . . , K, m=0, 1, . . . , ∞, where k is a subband number, and m is a time index of each subband signal, processing the subbands of the audio signal, wherein a subband has a gain, said processing including controlling the gain of the audio signal in ones of said subbands, wherein the gain in a subband is reduced as a level of estimated noise components increases with respect to the level of speech components, the change of the gain in a subband being performed according to a set of parameters continuously updated for each time index m, said parameters being dependent only on their respective prior value at time index (m−1), characteristics of the subband at time index m, and a set of predetermined constants, wherein the level of estimated noise components is determined at least in part by comparing an estimated noise components level with the level of the audio signal in the subband and increasing the estimated noise components level in the subband by a predetermined amount when the audio signal level in the subband exceeds the estimated noise components level in the subband by a limit for more than a defined time, wherein said defined time is updated according to a counter, said counter being robust with respect to false alarms and resets due to temporary signal fluctuations by introducing a hand-off counter, and changing the processed audio signal from the frequency domain to the time domain to provide an audio signal in which speech components are enhanced.

8. The computer readable storage medium of claim 7 wherein the estimated noise components are determined by a voice-activity-detector-based noise-level-estimator device or process.

9. The computer readable storage medium of claim 7 wherein the estimated noise components are determined by a statistically-based noise-level-estimator device or process.

10. A non-transitory computer-readable storage medium encoded with a computer program for causing a computer to perform steps comprising:

changing the audio signal from a time domain representation to a plurality of subbands in a frequency domain representation, producing K multiple subband signals, $Y_k(m)$, k=1, . . . , K, m=0, 1, . . . , ∞, where k is the subband number, and m is a time index of each subband signal, processing subbands of the audio signal, wherein a subband has a gain, said processing including controlling the gain of the audio signal in ones of said subbands, wherein the gain in a subband is reduced as a level of estimated noise components increases with respect to the level of speech components, wherein the level of estimated noise components is determined at least in part by obtaining and monitoring the signal-to-noise ratio in the subband and increasing the estimated noise components level in the subband by a predetermined amount when the signal-to-noise ratio in the subband exceeds a limit for more than a defined time, the change of the gain in a subband being performed according to a set of parameters continuously updated for each time index m, said parameters being dependent only on their respective prior value at time index (m−1), characteristics of the subband at time index m, and a set of predetermined constants, and said defined time being updated according to a counter, said counter being robust with respect to false alarms and resets due to temporary signal fluctuations by introducing a hand-off counter, and changing the processed audio signal from the frequency domain to the time domain to provide an audio signal in which speech components are enhanced.

11. The computer readable storage medium of claim 10 wherein the estimated noise components are determined by a voice-activity-detector-based noise-level-estimator device or process.

12. The computer readable storage medium of claim 10 wherein the estimated noise components are determined by a statistically-based noise-level-estimator device or process.

* * * * *